US006520300B2

(12) United States Patent
Balzer-Apke et al.

(10) Patent No.: US 6,520,300 B2
(45) Date of Patent: Feb. 18, 2003

(54) METHOD FOR REGULATING THE BRAKE(S) OF AN ESCALATOR OR A MOVING WALKWAY

(75) Inventors: Ludwig Balzer-Apke, Velbert (DE); Dirk Lange, Dortmund (DE); Sascha Neumann, Bochum (DE); Alexander Pietz, Hattingen (DE)

(73) Assignee: Kone Corporation (FI)

( * ) Notice: Subject to any disclaimer, the term of this patent is extended or adjusted under 35 U.S.C. 154(b) by 0 days.

(21) Appl. No.: 10/056,207

(22) Filed: Jan. 28, 2002

(65) Prior Publication Data

US 2002/0109404 A1 Aug. 15, 2002

Related U.S. Application Data

(63) Continuation of application No. PCT/EP00/06489, filed on Jul. 8, 2000.

(30) Foreign Application Priority Data

Jul. 28, 1999 (DE) ..... 199 35 521

(51) Int. Cl.[7] ..... B66B 25/00
(52) U.S. Cl. ..... 188/181 C; 188/74
(58) Field of Search ..... 188/29, 171, 181 C, 188/74; 198/322, 323, 854; 318/362

(56) References Cited

U.S. PATENT DOCUMENTS 4,231,452 A * 11/1980 Kraft ..... 188/171
4,588,065 A * 5/1986 Maiden et al. ..... 198/323
4,664,247 A 5/1987 Wolf et al.
4,717,865 A * 1/1988 Caputo ..... 318/362

FOREIGN PATENT DOCUMENTS

DE 2003951 8/1971
DE 3509207 A1 9/1985
DE 29801665 U1 6/1999

OTHER PUBLICATIONS

Kobune Kazumi, 07125963, May 16, 1995, Patent Abstracts of Japan.
Terasaki Masayuki, 07252074, Oct. 3, 1995, Patent Abstracts of Japan.
International Industrial Vehicle Technology, The International Review of Industrial Vehicle Design and Engineering, Lift Truck & Materials Handling Edition, Jan. 1999, pp. 133–135.
Lenze E5b, Mechatronic Brake System.
Fordermittel Journal E5a, pp. 20–21, Apr. 1999.

* cited by examiner

*Primary Examiner*—Christopher P. Schwartz
(74) *Attorney, Agent, or Firm*—Venable; Robert Kinberg

(57) ABSTRACT

The invention relates to a method for regulating the brake(s) of an escalator or moving walkway, independently of the load. According to the invention, actual values are supplied to at least one regulator which contains at least one nominal value, the regulator intermittently performs a comparison between the nominal and actual values and controls at least one brake magnet using these values. The brake magnet or magnets in turn regulate(s) the brake(s) in such a way that a predeterminable linear braking deceleration can be achieved, whereby nominal values, in particular, in the form of several temporary deceleration values, are stored in the regulator in nominal value fields or nominal zones.

8 Claims, 2 Drawing Sheets

METHOD FOR REGULATING THE BRAKE(S) OF AN ESCALATOR OR A MOVING WALKWAY

CROSS-REFERENCE TO RELATED CASES

The present application is a continuation of pending International Application No. PCT/EP00/06489 filed Jul. 8, 2000, and claims priority of German Patent Application No. 199 35 521.5 filed Jul. 28, 1999. The disclosure of the aforementioned International Application and the priority application is incorporated herein by reference.

BACKGROUND OF THE INVENTION

The invention relates to a method for regulating the brake(s) of an escalator or a moving walkway.

For stopping the step or pallet band of an escalator or a moving walkway in response to safety elements, mechanically or electromechanically actuated brakes, in particular shoe brakes, have essentially been used so far. These brakes are usually spring-loaded, the effect of the spring being eliminated by a magnet coil, such that the brake remains opened in the operating state. When stopping the escalator or moving walkway the effect of the electromagnet is eliminated and thereby the thus prevailing spring force is made use of. Usually the braking area and the balance weight are located independently from each other, but normally they form a coherent system in form of a brake drum. The balance weight serves for maintaining the brake path within the predetermined limits. An essential criterion for dimensioning the balance weight is the load caused by the number of passengers and for moving walkways it is essentially the length in connection with the passenger load thereon.

In case the emergency stopping device is actuated or safety switches and other safety means respond, the driving unit will be separated from the power supply. Simultaneously the brake will be applied.

The disadvantage of the known brake is that the brake is in part applied in a load dependent manner, that no equal brake paths can be obtained—since they are dependent on the load—, and that under certain constructional conditions (for instance excessive length of moving walkways) such big balance weights are required, that one reaches technical limits regarding the accommodation. Furthermore, a higher wear of the brake linings can be expected, whereby a continuous adjustment of the mechanical brakes becomes necessary due to safety reasons.

From DE-A-35 09 207, a method and an apparatus for stopping sliding passenger transport installations, for instance an escalator, are known, in which the movement of the escalator is stopped in a controlled way, essentially independently from the load and the moving direction of the escalator. The deceleration is monitored and controlled continuously by a signal, which is provided by a speed converter, for instance a speedometer generator. Direct current is supplied to the windings of an alternating current motor serving as drive motor, the electrodynamic braking effect generated in the motor causing predetermined deceleration behaviour of the movement of the escalator. In the braking case, the windings of the drive motor are preferably supplied with a pulsating d.c. voltage, which is formed and controlled by means of a thyristor circuit, which is controlled by electronic elements, and which provides a reference speed value for the escalator on the base of the speed of the escalator provided by a speed converter, for instance a speedometer.

Recently, frequency converters have been used for braking passenger transport installations, in particular escalators and moving walkways, so that, in certain circumstances, mechanical brakes as operational brakes to a large extent are no longer required. However, the frequency converters represent elements, which cause higher costs and may thus not be desired by clients in certain circumstances.

The U.S. Pat. No. 4,664,247 describes a brake control device for passenger conveyors such as escalators and moving walkways. The device relates to a sensor for measuring the speed of the passenger conveyor system (actual value) and generates an actual speed signal in analog form. A control signal that is also analog is furthermore generated (desired value). A comparison of the analog desired value and the actual value occurs in a following control device. The automatic controller generates a control signal that acts upon the braking magnet of a braking system in a delayed manner, such that a soft, step-by-step delay is possible, wherein the actual value must remain near the desired value. This device is designed to activate the brake gradually, meaning in a quasi analog form. An additional high-frequency signal is provided as control criterion for the brake, which varies step-by-step within a predetermined time interval between 100% and 0%, as well occurs. As a result of fluctuations in this high-frequency signal, in the detailed form, the actual load applies to the passenger conveyor (number of persons) is not actually taken into account, so that during a gradual braking of the passenger conveyor the braking is not considered to be uncomfortable by the users.

SUMMARY OF THE INVENTION

It is the object of the invention to improve a method for regulating the brake(s) of an escalator or a moving walkway, such that a control schema is formed, which, independent of the respectively applied load on the escalator or the moving walkway, can if necessary be integrated into existing systems without requiring particular assembly and cost expenditure.

This object is achieved by the method of the present invention, which utilizes one or more nominal stored speed values and compares them with actual speed values to provide control of the braking process in an escalator or moving walkway.

Other advantageous embodiments of the invention include use of sensors to provide actual speed values for comparison, use of fuzzy logic in carrying out brake control, and actuating a brake magnet independent of an energy supply for a drive of an escalator or moving walkway.

A braking device operating according to the method of the invention comprises at least one, in particular spring-loaded brake, e.g., a shoe brake, which can be controlled by at least one brake magnet, which deviating from this state of the technology can be controlled by a regulator performing a discontinuous actual value/desired value comparison.

Thus, the object of the invention provides a preferably closed control circuit, which can also be retrofitted in existing installations, and which can be integrated into new installations, on the one hand, and existing installations, on the other hand, without great expenditure and assembly.

The method according to the invention thus permits a load-independent braking of the step or pallet band for escalators and moving walkways, as compared to the known prior art, which essentially has the following advantages:

- always equal brake paths, since independent from the load;
- low wear of the operational brake, in particular of the brake shoes of a show brake;

at least partial reduction of the balance weight;

at least partially smaller dimensioning of the drive motor.

Using the method according to the invention respectively the braking device operating according to it, the speed of the escalator or moving walkway can be decreased in a defined way to the value 0 m/s, with substantially uniform deceleration. At the moment of response of for instance a safety element, a brake ramp is activated, whereby a uniform braking with linear deceleration can be achieved, while observing the brake path defined in the corresponding regulations. The regulator contains deceleration values as nominal value(s), which are intermittently compared to preferably speed values of the drive motor of the escalator or moving walkway.

According to further aspects of the invention, the brake magnet can be controlled independently from the power supply of the drive motor. This requires a slightly higher effort, since an independent power supply has to be provided; but for certain applications, in particular regarding technical safety aspects, these use applications are considered as a further alternative for improving the object of the invention in a useful way.

BRIEF DESCRIPTION OF THE DRAWINGS

The object of the invention can be applied to all kinds of brakes used with escalators and moving walkways. But it shall be preferably used with shoe brakes provided with spring-loaded brake levers.

The object of the invention is represented in the drawing by means of an exemplary embodiment described as follows.

DETAILED DESCRIPTION OF THE INVENTION

Figure 1:
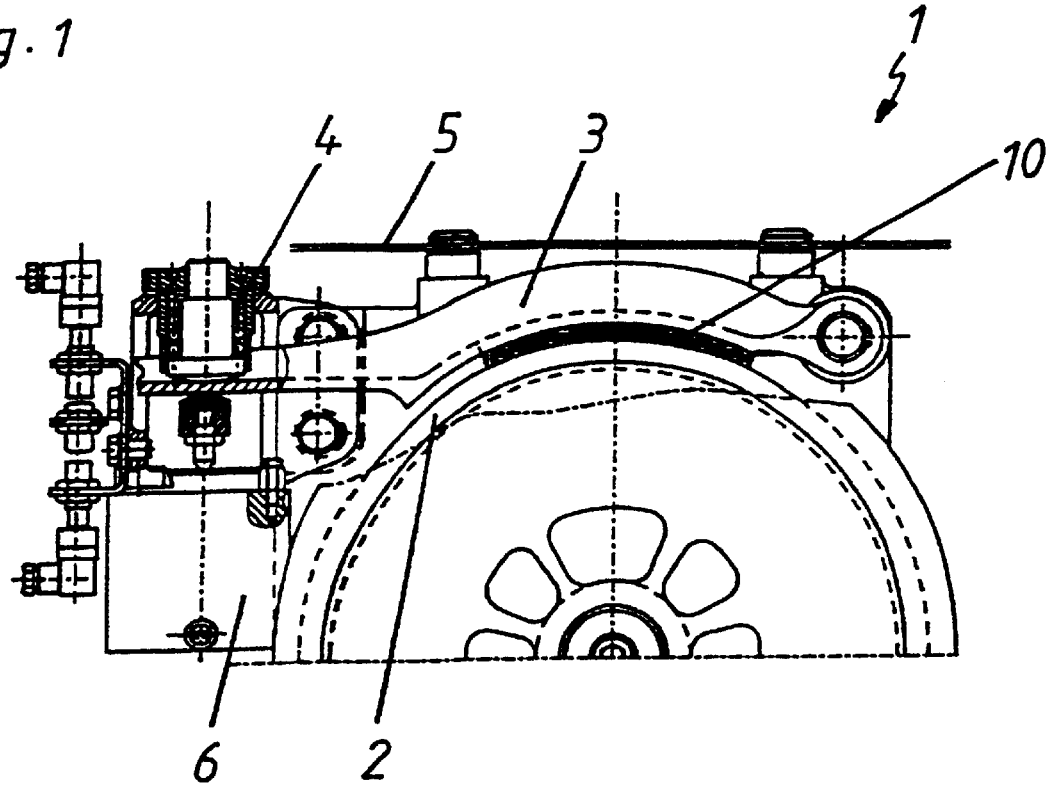
FIG. 1 shows a partial representation of the braking device of, for instance, an escalator.

FIG. 1 is a partial representation of brake 1 of a no further represented escalator. One can see a brake drum 2, a brake lever 3, a spring packet 4, a holding device 5 as well as a brake magnet 6, which is driven with direct current in this example.

Figure 2:
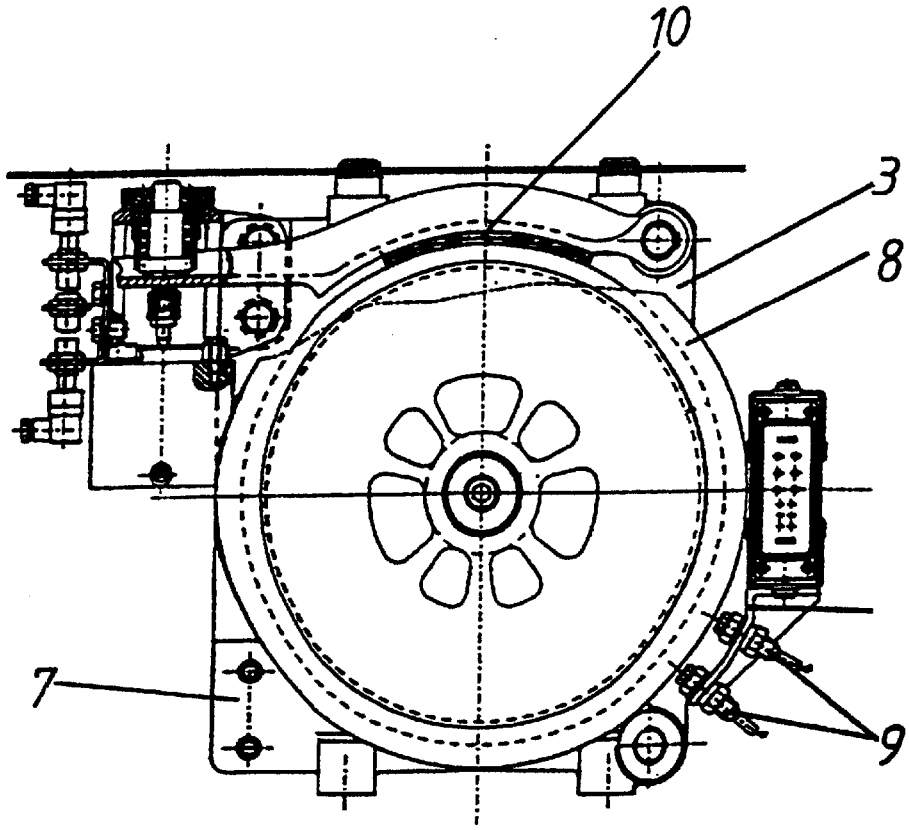
FIG. 2 shows a braking device according to FIG. 1, including an actual speed value determination.

FIG. 2 shows the same elements as already described. Furthermore, one can see the following components: housing 7 of drive motor 8 as well as sensors 9 (for instance proximity switch initiators) for determining the speed of drive motor 8.

The overspeed and low speed of drive 8, which is formed by an electromotor, is detected by initiators 9 and provided to a no further represented motor guard. In the normal state of the escalator, shoe brake 10 situated at brake lever 3 is released, i.e. it does not rest upon drive motor 8 formed by a brake drum. In case of switching off the drive, spring 4 will press brake lever 3 on the brake drum, which forms drive motor 8, and thus produce a braking moment. Herein, brake lever 3 is pressed onto the brake drum and stops the step band.

Such mechanically acting brake devices 1 are state of the art, but every other kind of brake, eventually not of the mechanical type, can also be used.

Figure 3:
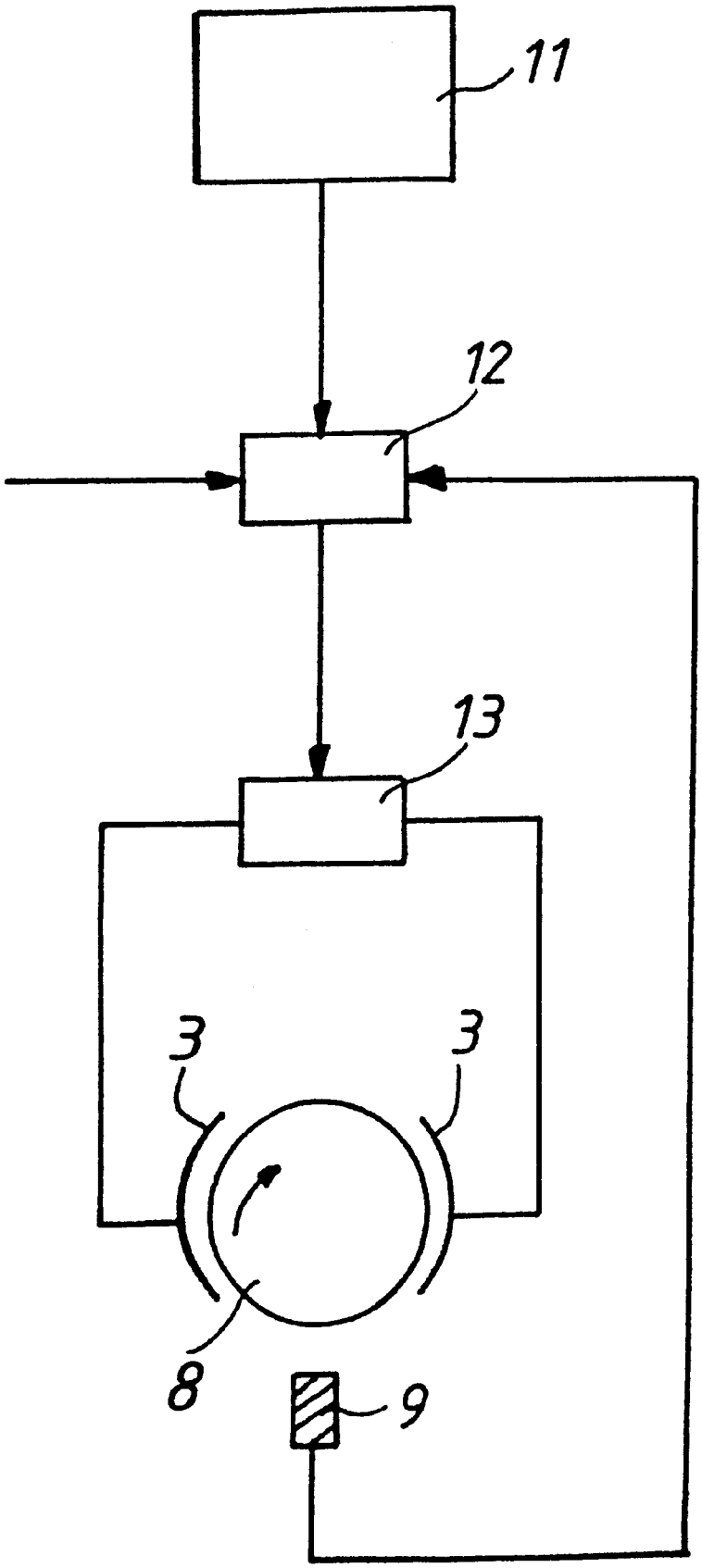
FIG. 3 is a functional diagram of the method according to the invention for regulating the braking device according to FIGS. 1 and 2.

FIG. 3 shows a schematic diagram of a regulating scheme for braking device 1 according to FIGS. 1 and 2. Reference numeral 11 designates the power supply. Reference numeral 12 refers to a regulator, and reference numeral 13 to a brake magnet. Electromotor 8 as well as brake lever 3 and speed sensors 9 are indicated. Preferably several predetermined nominal values regarding potential deceleration ramps are stored in regulator 12. In this example, speed sensors 9 intermittently determine the respective speed of drive motor 8 and provide it as an actual value to regulator 12. However, speed sensors 9 may alternatively provide the speed to regulator 12 on a continuous basis. Regulator 12 performs an intermittent comparison between the nominal and actual values, the results of which are transmitted to brake magnet 13 in the form of setting values, so that brake magnet 13 can in turn act on brake lever 3 in a regulating way.

As soon as the escalator is no longer driven, brake lever 3 according to the representation of FIGS. 1 and 2 will abruptly become active via brake magnet 6, which is no longer supplied with energy, since then the force of spring 4 will work. This abrupt stopping can cause problems with regard to a jerky deceleration of the step band of the escalator, which can, in certain circumstances, cause risks of injury, unless appropriate measures have been taken.

Due to the regulation using the comparison between nominal and actual values, this operation is now bridged by controlling brake magnet 13 in a defined way, should the occasion arise, also during a power cut, so that a substantially linear braking according to predetermined criteria (brake ramp) is possible. This is facilitated by the power supply 11 that supplies power to regulator 12 independent of a power supply to drive 8.

It is also possible, that several nominal values (S) are stored in the regulator in nominal value fields or nominal value zones in the form of brake ramps, which enable a so-called fuzzylogic-circuit, wherein regulator 12 then determines the best possible brake regulation or brake ramp as a function of the supplied actual values (I).

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method of load-dependent regulation of at least one brake in a passenger conveyor system, the method comprising the steps of:

obtaining at least one actual value of a performance parameter of the passenger conveyor system;

storing at least two predetermined nominal values of the performance parameter;

intermittently comparing the at least one actual value with the nominal values of the performance parameter; and utilizing a result of the comparing step to control at least one brake magnet to thereby provide load-dependent control of braking in a predetermined substantially linear fashion.

2. The method according to claim 1, wherein the performance parameter is a speed parameter.

3. The method according to claim 2, wherein the speed parameter comprises a speed of a drive of the passenger conveyor system.

4. The method according to claim 2, wherein the step of obtaining at least one actual value of a performance parameter comprises the step of:

obtaining the speed parameter intermittently.

5. The method according to claim 2, wherein the step of obtaining at least one actual value of a performance parameter comprises the step of:

obtaining the speed parameter continuously.

6. The method according to claim 1, wherein the step of utilizing a result of the comparing step includes the step of:

using fuzzy logic to control the at least one brake magnet.

7. The method according to claim 1, further comprising the step of:

providing power for carrying out the method steps from an independent power source, such that, should power to a drive of the passenger conveyor system be cut off, control of the at least one brake magnet is performed in a substantially linear fashion.

8. The method according to claim 1, wherein the at least two nominal values comprise a deceleration ramp.

* * * * *